US006130018A

United States Patent [19]

Kawata et al.

[11] Patent Number: 6,130,018

[45] Date of Patent: Oct. 10, 2000

[54] CARRIER FOR USE IN DEVELOPMENT OF ELECTROSTATIC LATENT IMAGE AND IMAGE FORMING APPARATUS USING THE CARRIER

[75] Inventors: Hideaki Kawata, Neyagawa; Akinori Koyama, Osaka; Nobuaki Kawano, Higashiosaka, all of Japan

[73] Assignee: Kyocera Mita Corporation, Osaka, Japan

[21] Appl. No.: 09/361,412

[22] Filed: Jul. 27, 1999

[30] Foreign Application Priority Data

Jul. 27, 1998 [JP] Japan ..... 10-211283
Jul. 27, 1998 [JP] Japan ..... 10-211284

[51] Int. Cl.[7] ..... G03G 9/107; G03G 9/113; G03G 21/00

[52] U.S. Cl. ..... 430/106.6; 430/108; 430/111; 399/350

[58] Field of Search ..... 430/106.6, 108; 399/350

[56] References Cited

U.S. PATENT DOCUMENTS 3,767,578 10/1973 Hagenbach et al. ..... 430/108
3,811,880 5/1974 Browning ..... 430/108
4,871,639 10/1989 Aoki et al. ..... 430/137
5,332,637 7/1994 Wilson et al. ..... 430/106.6

FOREIGN PATENT DOCUMENTS 4-317073 11/1992 Japan .
5-303237 11/1993 Japan .
7-181748 7/1995 Japan .
8314198 11/1996 Japan .

*Primary Examiner*—Roland Martin
*Attorney, Agent, or Firm*—Smith Patent Office

[57] ABSTRACT

A carrier for use in development of an electrostatic latent image and an image forming apparatus using the carrier, with which a stable charging ability is maintained for a long period of time, and a high density image free from fog can be formed. The carrier has magnetic material particles coated with a coating resin. The coating resin is a thermoplastic resin, with a hardness of rank F to B in the terms of the pencil scratch test, and is present in an amount of 0.5 to 5 parts by weight to 100 parts by weight of the magnetic material particles.

7 Claims, 3 Drawing Sheets

CARRIER FOR USE IN DEVELOPMENT OF ELECTROSTATIC LATENT IMAGE AND IMAGE FORMING APPARATUS USING THE CARRIER

This application is based on patent application Nos. 10-211283 and 10-211284 filed in Japan, the contents of which are hereby incorporated by reference.

BACKGROUND OF THE INVENTION

1. Field of the Invention

The present invention relates to a carrier for use in development of an electrostatic latent image and, more particularly, to a carrier for use in the development of an electrostatic latent image coated with a thermoplastic resin which ensures a prolonged use and a stable charging ability.

The present invention also relates to an image forming apparatus using a two-component developer as a developer, and, more particularly, to an image forming apparatus using the above carrier for use in the development of an electrostatic latent image.

2. Description of the Prior Art

In electrophotography, a "magnetic brush process" has seen extended use in developing an electrostatic latent image and, as the developer used therefor, a two-component developer comprised of a mixture of magnetic carrier particles and toner particles has been widely used.

One of the drawbacks of the two-component developer is that toner particles are liable to become fused to the carrier surface, namely, the production of spent toner. It is known that spent toner causes fog and lowers the charging ability of a carrier and image density. Specifically, the spent toner is the phenomenon that toner particles adhere to and deposit on the surface of a magnetic carrier in a film form. The constituent of the magnetic carrier surface becomes similar to the toner constituent, causing a frictional charge, and failing to obtain a predetermined charging ability. Thus, upon the occurrence of spent toner, the magnetic carrier needs to be discarded and then replaced with a new magnetic carrier.

To solve the above problem, there has been proposed a variety of resin-coated carriers in which the carrier particle surface is coated with various resins. In view of resistance to surface contamination, the use of fluorocarbon polymers have been proposed. JP-A-314198/1996 proposes to use, as a coating resin, polyolefin having a specific weight-average molecular weight (Mw), and number-average molecular weight (Mn), in order to avoid adhesion of toner, etc. This has some measure of success in preventing adhesion of toner particles and the like.

With the former means, however, fluorine itself has a strong chargeability of negative property. Accordingly, the charging ability of toner into negative property is low, thereby the use thereof is restricted. With the latter means, the developing property after a prolonged use is not yet fully satisfied.

SUMMARY OF THE INVENTION

It is an object of the present invention to provide a carrier for use in development of electrostatic latent image, and an image forming apparatus which has overcome the problems residing in the prior art, and ensures a stable charging ability over a prolonged time, and a high density image free from fog.

According to an aspect of the present invention, a carrier for use in development of electrostatic latent image includes a magnetic material particle coated with a coating resin. The coating resin includes a thermoplastic resin having a hardness of rank F to B in the terms of the pencil scratch test, and is present in an amount of from 0.5 to 5 parts by weight to 100 parts by weight of the magnetic material particle.

According to another aspect of the present invention, an image forming apparatus comprises a developing section for developing an electrostatic latent image formed on an image bearing member by a developer comprised of a carrier component and a toner component; a transferring section for transferring a toner image on the image bearing member to copy paper; and a cleaning section having a cleaning blade for cleaning a surface of the image bearing member after transfer. The carrier component includes carrier particles each having a magnetic material particle coated with a coating resin. The coating resin includes a thermoplastic resin having a hardness of rank F to B in the terms of the pencil scratch test, and is present in an amount of 0.5 to 5 parts by weight with respect to 100 parts by weight of the magnetic material particle.

The carrier, even if spent toner adheres, ensures a long use and offers a stable charging ability because the resin surface of the carrier is renewed by successive peelings of resin surfaces.

The image forming apparatus enables a stable charging of the toner for a prolonged time, thanks to the use of the above carrier. In addition, even if coating resin pieces separated from the carrier surface move to and adhere to the image bearing member, they can be effectively cleaned out from the image bearing member surface, thanks to the cleaning blade for cleaning the image bearing member surface.

DETAILED DESCRIPTION OF THE PREFERRED EMBODIMENTS OF THE INVENTION

Figure 1:
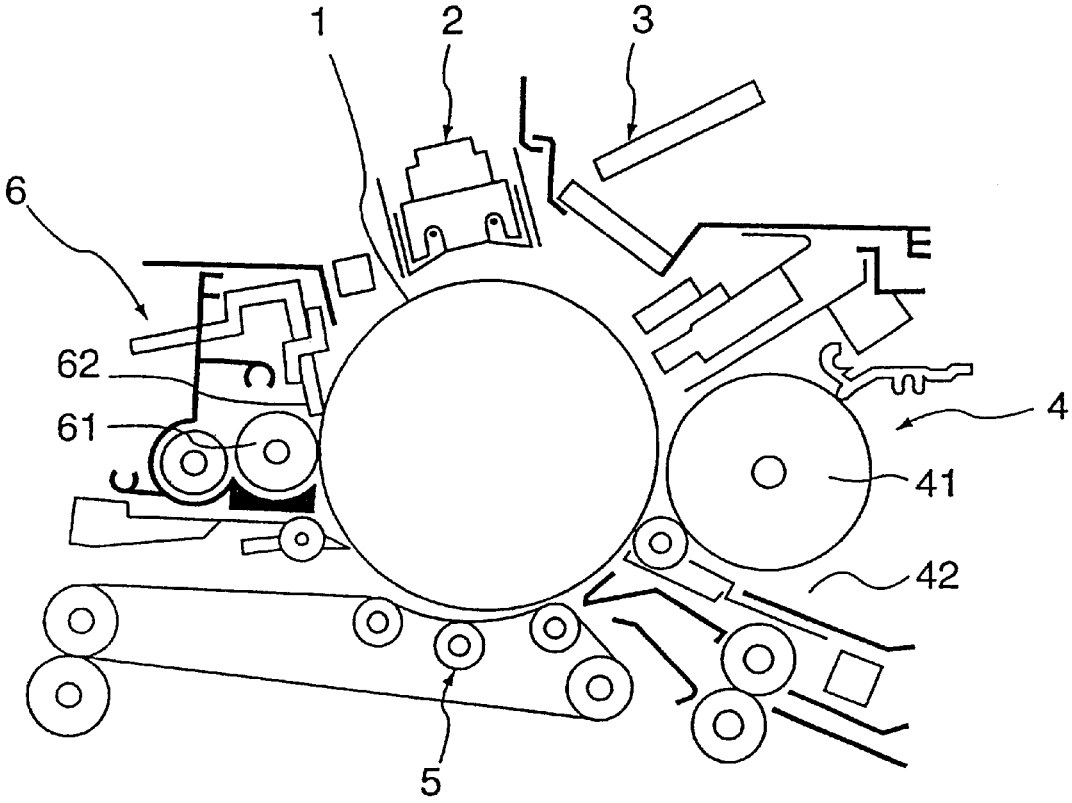
FIG. 1 is a schematic view of an image forming apparatus embodying the present invention.

According to a first preferred embodiment of the present invention, a carrier for use in development of an electrostatic latent image, having magnetic material particles coated with a coating resin (hereinafter referred to as "carrier" in some cases) has a noticeable feature that the coating resin is a thermoplastic resin with a hardness of rank F to B in the terms of the pencil scratch test. This ensures a stable charging ability over a prolonged period and enables formation of a high density image free from fog.

Conventionally, it has been aimed mostly to prevent toner spent from adhering to the carrier surface. Whereas in the present invention, assuming it is unavoidable that toner spent adheres to the carrier surface to a certain degree, the resin of the carrier surface to which spent toner adheres is allowed to peel successively so that a new resin surface free from spent toner appears on the carrier surface.

For successive peeling of a coating resin, it is necessary to use a thermoplastic resin as a coating resin. Since a thermosetting resin becomes extremely tight, resin peeling can be suppressed. It is also necessary that the coating resin has a hardness of rank F to B in the terms of the pencil scratch test. Above the value F, the peeling of resin is retarded and a new coating surface is hard to appear on the carrier surface. Below rank B, the peeling of resin proceeds to excess and it is impossible to use the carrier over a prolonged period.

In the present embodiment ranks of pencil scratch test are those determined by the following procedure. Firstly, a toluene solution of resin to be measured is uniformly applied with a brush to a test plate (a steel plate of 150 mm×70 mm×0.8 mm). The test plate is then placed in an oven ("PERFECT OVEN PS-212" manufactured by Tabai Espec Co., Ltd.) and dried and cured for one hour at 100° C. for a thermoplastic resin. For a thermosetting resin, that is carried out at the temperature at which the thermosetting resin is cured. The resulting plate is subjected to measurement by a hand writing method defined in JIS standard (K 5400-1990).

Further, a resin coating is present in an amount of 0.5 to 5 parts by weight to 100 parts by weight of magnetic material particles. Below 0.5 part by weight, the entire surface of magnetic material particles cannot be coated with a coating resin, alternatively, even if coated, the resin layer is thin and fails to withstand a prolonged use of the carrier. Above 5 parts by weight, there are problems that the carrier may aggregate and magnetic material particles cannot be uniformly coated with resin.

A carrier for use in development of electrostatic latent image may preferably satisfy the following Equation (1)

$$(Y+2) \leqq X \leqq (Y+10) \quad (1)$$

wherein X denotes an absolute value of the saturated charge quantity of toner particles owing to friction with magnetic material particles, and Y denotes an absolute value of the saturated charge quantity of toner particles owing to friction with carrier particles. Specifically, in the event that the peeling of a coating resin proceeds by repetitive use of the carrier, and the resin layer becomes thinned and contains no resin, causing a partial exposure of the surface of magnetic material particles, it is possible to maintain the charging ability to toner and further extend the duration of service of the carrier by setting such that the charging ability of the magnetic material particles is higher than that of the carrier coated with the coating resin.

When the saturated charge quantity X of toner particles owing to friction with the magnetic material particles is below the lower limit of Equation (1), the charging ability of the magnetic material particles is insufficient and the duration of service of the carrier cannot be extended satisfactorily. When the saturated charge quantity X is above the upper limit of Equation (1), the charging ability of magnetic material particles is extremely high and toner is overcharged, which might reduce image density.

A carrier for use in development of electrostatic latent image may preferably contain particles having chargeability and/or conductivity with a particle size of from 0.005 to 1 μm, in an amount of from 0.1 to 10 parts by weight to 100 parts by weight of a coating resin. That is, the presence of particles having chargeability and/or conductivity in a coating resin facilitates the control of charging to toner particles and also promotes the peeling of resin, thereby maintaining the charging ability of the carrier over a prolonged period.

When the particle size is below 0.005 μm, promotion of the peeling of resin is not accomplished. Above 1 μm, such promotion is exerted in excess and thus it might be difficult to use the carrier for a prolonged period.

When the amount of particles is below 0.1 part by weight, the charging control cannot be performed satisfactorily. Above 10 parts by weight, the peeling of resin is accelerated and it might be difficult to use the carrier for a prolonged period.

An inventive image forming apparatus uses the above-mentioned carrier having magnetic material particles coated with a specific coating resin as carrier. A cleaning blade is employed as means for cleaning an image bearing member surface. The use of the above carrier ensures a stable charging ability over a long period of time and enables formation of a high density image free from fog. On the other hand, since a coating resin functions as a charging material to toner particles, there is necessarily used one which can be charged to the polarity opposite to that of toner particles. Particularly, when a reversal process is employed as a developing method, the coating resin separated from a carrier particle (hereinafter referred to as "coating resin pieces" in some cases) might be mixed into a developer, and the coating resin pieces might move to and adhere to a non-latent image part of an image bearing member. Since the major part of the coating resin pieces adhered on the image bearing member are charged to the polarity opposite to that of the toner particles, they remain on the image bearing member without moving to a copy paper in a transfer process. Image forming apparatus are usually provided with a cleaner for cleaning non-transferred toner particles or the like on an image bearing member. Such cleaner is, however, primarily aimed to recover non-transferred toner particles, paper powder, etc. Therefore, some of the conventional cleaners cannot fully recover the coating resin pieces.

With this in mind, the present inventors had intensive consideration with regard to means for cleaning coating resin pieces on an image bearing member, and the present invention was accomplished when it was found that a cleaner using a cleaning blade was the most suitable.

An image forming apparatus according to an embodiment of the present invention will be described by referring to FIG. 1. A photoreceptor 1 is used as an image bearing member. The photoreceptor 1 whose surface is positively charged uniformly by a charging unit 2, is subjected to electrostatic latent image formation by an exposure unit 3. In a developing unit 4, toner particles are adhered to the electrostatic latent image for visualization by a magnetic brush of a developer 42 comprised of toner particles and the above-mentioned carrier particles, which is provided on a developing roller 41 containing a magnet therein. In a transfer unit 5, a toner image on the photoreceptor 1 is transferred to copy paper. Therefore, the copy paper with the toner image transferred is heated and fixed on the copy paper by pressure in a fixing unit (not shown). Non-transferred toner particles and coating resin pieces remain on the photoreceptor 1, and they are previously cleaned by a cleaning brush 61 and then completely cleaned by a cleaning blade 62 provided in a cleaning unit 6.

It may be preferable to provide the image bearing member or photoreceptor with a photosensitive layer comprised of amorphous silicon. Since the photoreceptor has a high surface hardness, the contact pressure of a cleaning blade to the photoreceptor can be increased to ensure a complete cleaning of the coating resin pieces remaining on the photoreceptor. In addition, this photoreceptor has a high sensitivity throughout the range of visible radiation and has excellent heat resistance.

As the coating resin used in the present embodiment, any thermoplastic resin is useable and no special limitations are imposed thereon. There are, for example, polyethylene, polypropylene, polyvinyl chloride, poly-4-methylpentene-1, polyvinylidene chloride, ABS (acrylonitrile-butadiene-styrene) resin, polystyrene, (meth)acrylic resin, polyvinyl alcohol resin, and thermoplastic elastomers such as polyvinyl chloride, polyurethane, polyester, polyamide and polybutadiene series.

Of these, (meth)acrylic resin is more preferred. Specifically, a preferable resin may be one which is obtained by copolymerization of acrylate or methacrylate, as the main component, and an unsaturated monomer represented by the following formula:

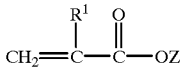

(2)

wherein $R^1$ is hydrogen atom, methyl group or ethyl group, and Z is hydrocarbon group having 4 or more carbon atoms.

Examples of acrylate and methacrylate are methyl (meth) acrylate, ethyl (meth)acrylate, isopropyl (meth)acrylate, n-butyl (meth)acrylate, isobutyl (meth)acrylate, n-amyl (meth)acrylate, isoamyl (meth)acrylate, n-hexyl (meth) acrylate, 2-ethylhexyl (meth)acrylate and n-octyl (meth) acrylate. The term "(meth)acrylate" is understood to mean acrylic acid or methacrylic acid.

As examples of substituent represented by Z in the formula (2), there may be alicyclic hydrocarbon group having 4 or more carbon atoms, such as cyclohexyl group, methylcyclohexyl group and cyclododecyl group; straight-chain or branched-chain alkyl group having 4 or more carbon atoms, such as butyl group, isobutyl group, tert-butyl group, 2-ethylhexyl group, heptyl group, octyl group, nonyl group, decyl group, undecyl group, dodecyl group, pentadecyl group and octadecyl group; and polycyclic hydrocarbon group having 4 or more carbon atoms, such as bornyl group and isobornyl group. Of these, preferred are alicyclic hydrocarbon group, branched-chain alkyl group and straight-chain alkyl group having 6 or more carbon atoms.

As examples of unsaturated monomer represented by the formula (2), there may be cyclohexyl (meth)acrylate, methylcyclohexyl (meth)acrylate, cyclododecyl (meth)acrylate, tert-butylcyclohexyl (meth)acrylate, isobutyl (meth) acrylate, tert-butyl (meth)acrylate, lauryl (meth)acrylate, isobornyl (meth)acrylate, stearyl (meth)acrylate and 2-ethylhexyl (meth)acrylate. They can be used solely or in a combination of at least two of these.

Hardness of resin may be controlled by the kind and proportion of monomer used, and the molecular weight of resin. As an example, a copolymer of (meth)acrylic resin being a suitable resin, and an unsaturated monomer of the formula (2) will be given here for illustration. The (meth) acrylic resin can impart tightness of resin and the unsaturated monomer of the formula (2) can impart brittleness of resin. Therefore, the desired hardness is obtainable by adjusting the proportion of the monomer.

The material for magnetic material particles used in the present embodiment is not particularly limited. There may be, for example, magnetic material metals such as iron, nickel and cobalt, and alloys thereof, alloys containing rare earth element; and iron oxide such as soft ferrite, e.g., hematite, magnetite, manganese-zinc ferrite, nickel-zinc ferrite, manganese-magnesium ferrite and lithium ferrite, and copper-zinc ferrite, and mixtures thereof. Magnetic material particles used in the embodiment may be prepared with sintering or atomizing-process, by using the above material.

Magnetic material dispersion resin may be also useable as magnetic material particles. As a magnetic material, the above-mentioned material for magnetic material particles may be used. As examples of binder resin, there may be vinyl resin, polyester resin, epoxy resin, phenol resin, urea resin, polyurethane resin, polyimide resin, cellulose resin, and polyether resin, and mixtures thereof.

Preferable particle size of magnetic material particles may be usually from 30 to 200 $\mu$m, especially from 50 to 150 $\mu$m, on the basis of electron microscopy.

The apparent density of magnetic material particles may be usually from 2.0 to 3.0 g/cm$^3$, though that of magnetic material depends upon its composition and surface structure.

The saturation magnetization of magnetic material particles may be preferably from 40 to 70 Am$^2$/kg.

In the present embodiment, to coat the surface of magnetic material particles with a coating resin, a solution or dispersion liquid of a coating resin may be applied to magnetic material particles. As examples of solvent for the application liquid, there may be an aromatic hydrocarbon solvent such as toluene and xylene; ketone solvent such as acetone, methylethyl ketone, methylisobutyl ketone and cyclohexane; cyclic ethers solvent such as tetrahydrofuran and dioxane; alcohol solvent such as ethanol, propanol and butanol; Cellosolve solvent such as ethyl Cellosolve and butyl Cellosolve; ester solvent such as ethyl acetate and butyl acetate; and amide solvent such as dimethyl formamide and dimethyl acetamide. They may be used solely or in a combination of at least two of these. A preferable concentration of resin compositions in an application liquid may be usually from 0.001 to 30 wt %, especially from 0.01 to 2 wt %.

As a method of applying a coating resin to magnetic material particles, there are, for example, the spray drying method, the fluid bed method, spray drying method using a fluid bed, and the dipping method. Of these, the fluid bed method may be particularly preferable because an effective application is attained with less coating resin.

The quantity of coating resin is adjustable. For the fluid bed method, its adjustment may be effected by the amount of resin liquid and spraying time.

In another preferred embodiment, the saturated charge quantity of magnetic material particles depends upon its chemical composition, particle size, particle shape and particle surface state. The saturated charge quantity of carrier particles depends upon the chemical composition of a coating resin, physical properties including frictional charge tendency, and coating amount, in addition to the above-mentioned factors with respect to the saturated charge quantity of magnetic material particles. A carrier for use in development of an electrostatic latent image which satisfies Equation (1) may be obtained by selection and a combination of these factors.

The absolute value of the saturated charge quantity of toner particles owing to friction with magnetic material particles is usually from 5 to 35 $\mu$C/g, preferably from 10 to 30 $\mu$C/g. The carrier may be of high or low electric resistance, and its electric resistance is usually from $2\times10^5$ to $2\times10^{15}\Omega\cdot$cm, preferably from $2\times10^7$ to $2\times10^{13}\Omega\cdot$cm.

Figure 2:
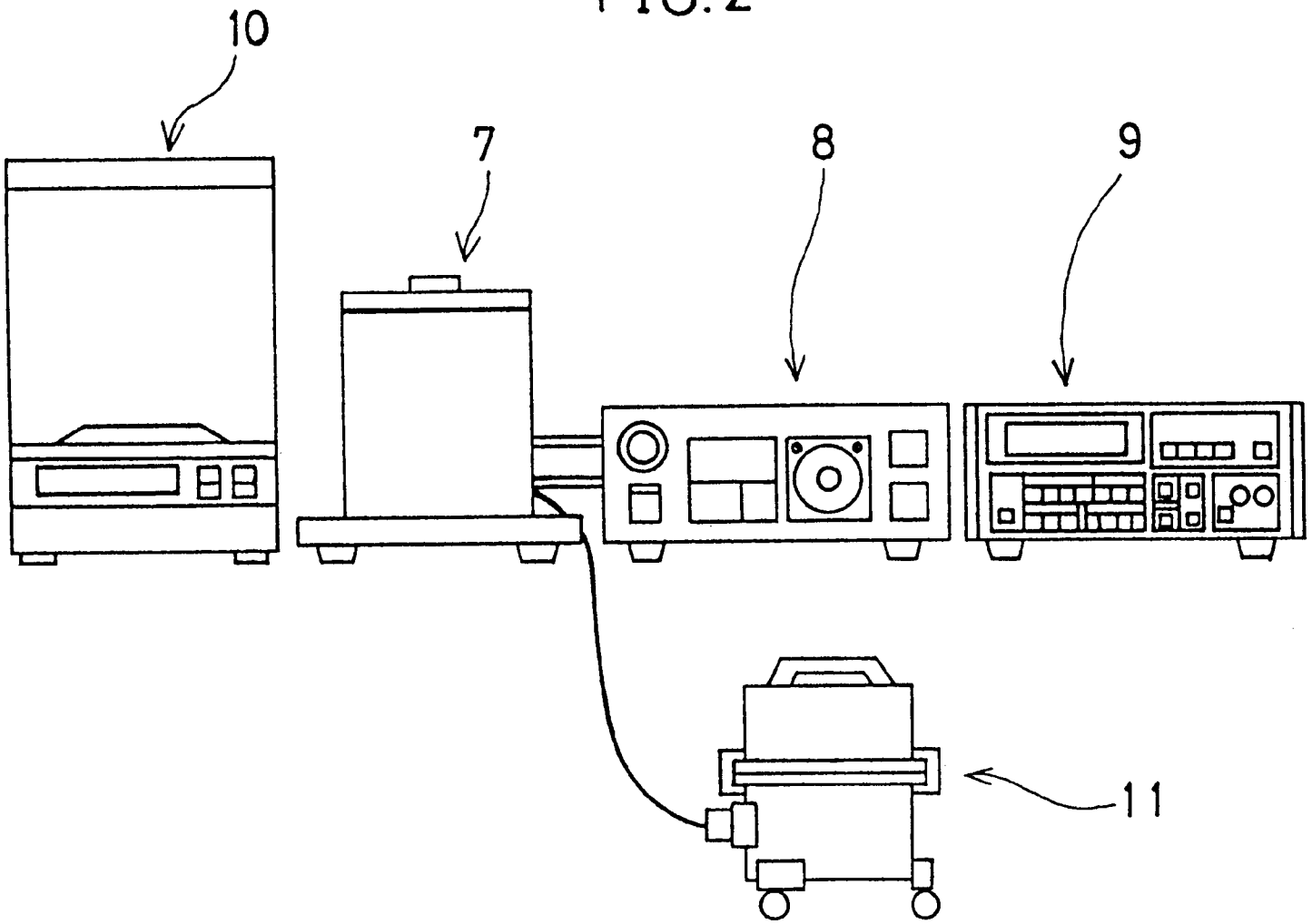
FIG. 2 is a diagram schematically showing a charge measuring system with an isolation aspirator.
Figure 3:
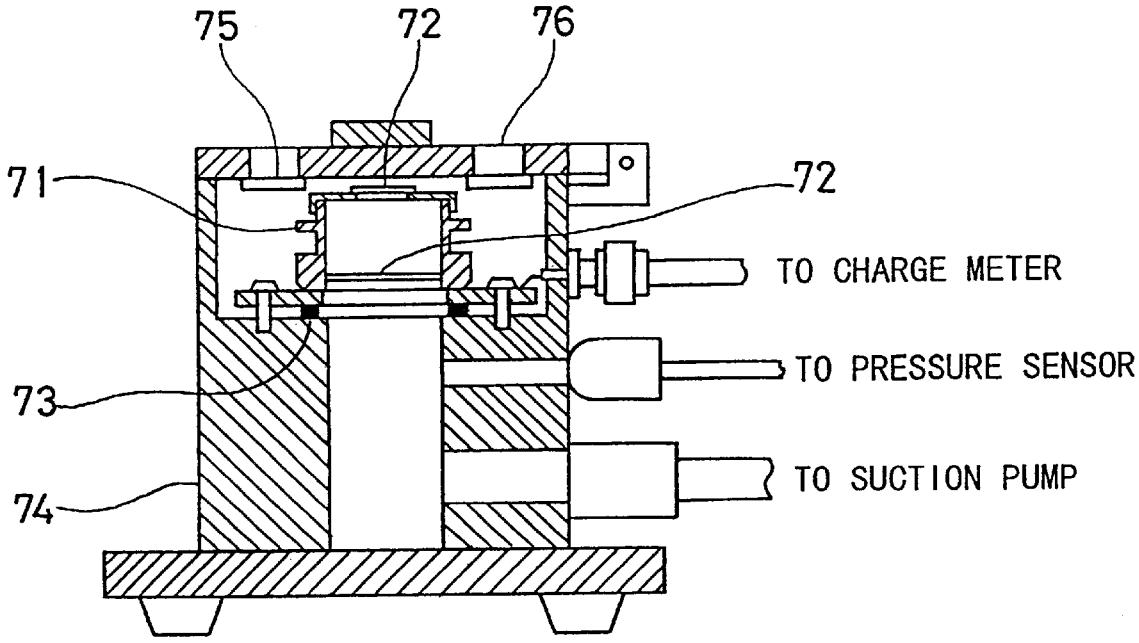
FIG. 3 is a sectional view showing a measuring part of the measuring system.

In the embodiment, measurement of the saturated charge quantity is made with a charge measuring system with an isolation aspirator manufactured by Sankyo Piotech Co., Ltd. FIG. 2 shows schematically this measuring system which comprises a main body measuring portion 7, a main body control portion 8, a charge meter 9, a balance 10 and a suction pump 11. FIG. 3 shows a cross-section of the main body measuring portion 7. A measuring procedure will be described. Firstly, a 400-mesh wire-netting 72 is attached to a faraday gauge 71 at an upper position and a lower position, respectively, and the mass of the empty faraday gauge 71 is measured. The mesh-netting 72 is replaced per ten measurements. A sample comprised of carrier particles and toner particles is weighed with the balance 10 of 0.50±0.10 g, and the sample is then placed in the faraday gauge 71 attached to the main body measuring part 7. Suction from the faraday gauge 71 is started at a suction pressure of $2.0\times10^3\pm0.1\times10^3$ Pa, and suction time of 60 sec. A maximum charge quantity during the suction time is measured on the charge meter 9. Thereafter, the mass of the faraday gauge 71 is measured. Then, the mass of the faraday gauge 71 after measurement is subtracted from the mass of the faraday gauge 71 immediately after placing the sample, to convert the sucked toner mass. Based on the above measurements, the charge quantity of the carrier is calculated from the following equation:

$$\text{Carrier Charge quantity } (\mu C/g) = \text{Measured Charge quantity}/\text{Toner Mass}$$

As a standard toner used in the above measurement, one which is obtained in the following procedure is employed. Specifically, (i) 100 parts by weight of resin in which the ratio of aliphatic alcohol polyester resin as a binder resin (20.1 mol % of ethylene glycol; 27.5 mol % of neopentyl glycol; 40.2 mol % of terephthalic acid; and 12.2 mol % of 1,2,4-benzenetricarboxylic anhydride) to aromatic polyester resin (48.6 mol % of polyoxypropylene-(2,2)-2-2-bis(4-hydroxyphenyl) propane; and 49.6 mol % of terephthalic acid) is 75 to 25, (ii) 8.0 parts by weight of "Raven 1255" as carbon black, and (iii) 5.0 parts by weight of "carnauba wax" as wax, are mixed and kneaded, followed by pulverization and classification, to obtain toner particles with a mean particle size of 9.0 $\mu$m. Into this toner particles, 0.9 part by weight of magnetite as a finishing agent ("BL220W", manufactured by Titan Kogyo K. K.), and a hydrophobic silica ("R812S", manufactured by Nippon Aerosil Co., Ltd.) are added and mixed with high speed stirring by a Henschel's mixer to obtain toner particles, which is employed as a standard toner.

In still another preferred embodiment, in order to incorporate particles having chargeability and/or conductivity with a predetermined particle size, into a coating resin, the particles may be added into a solution or dispersion liquid of the coating resin, which solution or dispersion may be then applied to the magnetic material particles. Alternatively, after a coating resin is applied to the surface of magnetic material particles and then dried, the particles are allowed to adhere to and bury in the resin by mechanical impact force.

As particles having chargeability suitably used in the embodiment, there may be, for example, metal oxides such as silica, chrome oxide, iron oxide, manganese oxides, molybdenum oxide, titanium oxide, tungsten oxide, vanadium oxide, aluminum oxide, magnesium oxide, silane oxide and zirconia oxide; dyes such as salicyl acid derivative and azo metal complex; and organic salt such as quaternary ammonium salt.

As conductive particles, there may be, for example, carbon black such as acetylene black and furnace black; carbide such as silane carbide, titanium carbide and zirconia carbide; and nitride such as boron nitride, neodymium nitride, titanium nitride and zirconia nitride.

A carrier for use in development of an electrostatic latent image according to the embodiments may be combined with toner particles in itself well known, for use in developing an electrostatic latent image, as a two-component developer. Toner particles for two-component developer are obtained by dispersing a coloring agent, charge control agent and mold releasing agent into a binder resin, followed by granulating and, as desired, adding a flow improver.

Preferable toner particles to be combined with a carrier for use in development of electrostatic latent image may be one which contains no charge control agent that is the main cause of spent toner (hereinafter referred to as "CCA less-toner" in some cases), from the point of view of increasing the carrier lifetime.

As a binder resin being one toner component, a thermoplastic resin and a thermosetting resin which is not cured or of initial condensation product, may be used. There are, for example, vinyl aromatic resin such as polystyrene, styrene-acrylic copolymer, acrylic resin, poly(vinyl acetal) resin, polyester resin, epoxy resin and phenol resin.

Charge control agent is usually employed to control the charge quantity of toner. Preferable charge control agents having positive chargeability may be nigrosine base and quaternary ammonium salt. Preferable charge control agents having negative chargeability may be metal complex dye, salicylic acid derivative and sulfonic acid derivative. When CCA less-toner is used, no charge control agent is required and thus it is necessary to allow a binder resin to perform part of charge control action. For this, it is necessary to use, as part of toner binder resin, a copolymer or resin composition having an anionic or cationic polar group. As examples of cationic polar group may be basic nitrogen containing group such as primary, secondary, tertiary or quaternary ammonia group, amide group, imino group, imide group, hydrazino group, guanidino group and amidino group. As examples of anionic polar group may be arbitrary polar groups such as carboxylic acid, sulfonic acid and phosphonic acid. As examples of the above resin may be ones which are obtained by copolymerization of a cationic or anionic polar group containing monomer, and other monomer or resin, by means of random copolymerization, block copolymerization, or grafting copolymerization.

As the coloring agent incorporated in the resin, the following pigments are useable:

Black pigments such as Acetylene black, Lamp black and Aniline black;

Yellow pigments such as Chrome yellow, Zinc chromate, Cadmium yellow, Yellow iron oxide, Mineral fast yellow, Nickel titanium yellow, Naples yellow, Naphthol yellow S, Hansa yellow G, Hansa yellow 10G, Benzidine yellow G, Benzidine yellow GR, Quinoline yellow lake, Permanent yellow NCG and Tartrazine lake;

Orange color pigments such as Chrome orange, Molybdenum orange, Permanent orange GTR, Pyrazolone orange, Vulcan orange, Indanthrene brilliant orange RK, Benzidine orange G, Indanthrene brilliant orange GK;

Red pigments such as Iron oxide red, Cadmium red, Red lead, Mercury sulfide cadmium, Permanent red 4R, Lithol red, Pyrazolone red, Watching red calcium salt, Lake red D, Brilliant carmine 6B, Eosin lake, Rhodamine lake B, Alizarine lake and Brilliant carmine 3B;

Violet pigments such as Manganese violet, Fast violet B and Methyl violet lake;

Blue pigments such as Iron blue, Cobalt blue, Alkali blue lake, Victoria blue lake, Phthalocyanine blue, Metal-free phthalocyanine blue, Partial chloride of phthalocyanine blue, Fast sky blue and Indanthrene blue BC;

Green pigments such as Chrome green, Chromium oxide, Pigment green B, Malachite green lake and Fanal Yellow Green G; and White pigments such as Zinc white, Titanium oxide, Antimony white, Zinc sulfide, Baryta powder, Barium carbonate, Clay, Silica, White carbon, Talc and Alumina white.

The above pigment is preferably present in an amount of from 2 to 20 parts by weight, more preferably from 5 to 15 parts by weight, to 100 parts by weight of a binder resin.

As a mold releasing agent incorporated in the binder resin, a variety of waxes and low molecular weight olefin resins may be employed. Olefin resin has a number average molecular weight (Mn) of from 1,000 to 10,000, particularly from 2,000 to 6,000. Examples of the olefin resin are polypropylene, polyethylene and propylene-ethylene copolymer. Especially preferred is polypropylene.

For CCA less-toner, it is desirable to further add magnetic powder in order to avoid toner scattering due to insufficient charge quantity. The magnetic powder may be added in small amounts, that is, from 0.1 to 5 parts by weight, especially from 0.5 to 3.0 parts by weight, to 100 parts by weight of a binder resin.

Examples of the above magnetic powder are triiron tetroxide ($Fe_3O_4$), diiron trioxide ($\gamma$-$Fe_2O_3$), iron oxide zinc ($ZnFe_3O_4$), iron oxide yttrium ($Y_3Fe_5O_{12}$), iron oxide cadmium ($CdFe_2O_4$), iron oxide gadolinium ($Gd_3Fe_5O_{12}$), iron oxide copper ($CuFe_2O_4$), iron oxide lead ($PbFe_{12}O_{19}$), iron oxide nickel ($NiFe_2O_4$), iron oxide neodymium ($NdFeO_3$), iron oxide barium ($BaFe_{12}O_{19}$), iron oxide magnesium ($MgFe_2O_4$), iron oxide manganese ($MnFe_2O_4$), iron oxide lantern ($LaFeO_3$), iron powder (Fe), cobalt powder (Co), and nickel powder (Ni). Particularly preferable magnetic powder may be fine particles of triiron tetroxide (magnetite). Preferable magnetite is of regular octahedron with a particle size of from 0.05 to 1 $\mu$m. This magnetite may be subjected to surface finishing with silane coupling agent, titan coupling agent, etc.

Toner particles may be prepared by a method in itself well known, such as pulverization classification, melt granulation, spray granulation, copolymerization. Pulverization classification is usually employed. The respective toner particles as described are premixed by a mixer such as Henschel's mixer, and kneaded by a kneader such as a biaxial extruder. This is then cooled, pulverized and classified to obtain toner particles.

Preferable toner particle size may be usually from 5 to 15 $\mu$m, particularly from 7 to 12 $\mu$m, which is based on median size with a Coulter counter.

If needed, a flow improver such as hydrophobic vapor deposition silica may be added to the toner particle surface such as to adhere thereto, in order to improve toner fluidity. Flow improver is preferably added in an amount of from 0.1 to 2.0 wt % per toner.

Also, the efficiency of transfer may be improved by incorporating spacer particles whose particle size is greater than that of the flow improver, namely, from 0.05 to 1 $\mu$m, into the flow improver.

As spacer particles, any organic or inorganic inactive typical particles may be used. In general, the above-mentioned magnetic powder is preferred, and the fine particles of triiron tetroxide (magnetite) is particularly preferable. This is because the magnetic powder residing on the toner particle surface is also effective in avoiding toner scattering.

Spacer particles such as the fine particles of triiron tetroxide (magnetite) is preferably present in an amount of from 0.1 to 10 wt % per toner.

When adding a flow improver and spacer particles into toner particles, it is desirable that both are premixed closely and the mixture is added into the toner particles and then mixed sufficiently.

Preferable material of a cleaning blade used in the embodiment may be elastomers such as urethane rubber and silicon rubber, and foam thereof. Particularly, silicon rubber causes less deterioration with time, thus maintaining good characteristic feature.

As a blade pressing system, either of a leading system and a trailing system may be employed. The abutting angle to an image bearing member depends upon the pressing system. Of these, the leading system in which the sum of the pressing force and the frictional force is exerted in the direction of compressing an elastic rubber blade, is preferable in cleaning coating resin pieces having a particle size smaller than toner particles, because it has a high cleaning force and can perform effectively with a relatively small pressing force.

In order to protect an image bearing member and also reduce the creep of a cleaning blade, there may be jointly used a pressure release mechanism for releasing the blade pressure at the time of halt, and a pre-cleaning roller or brush for avoiding inferior cleaning due to the intervention of coating resin pieces. Alternatively, a thrust mechanism and a scraper blade may be employed. The thrust mechanism moves a cleaning blade in a direction axially of an image bearing member. The scraper blade removes the substances such as coating resin pieces, adhered on the edge of a cleaning blade, per predetermined number of copied sheets.

Pressing conditions of a cleaning blade may be suitably set depending upon the material and properties of an image bearing member, the characteristic feature of toner and coating resin, and the temperature in an image forming apparatus. For instance, preferable pressing conditions in the leading system are as follows: the hardness of rubber is from 55 to 80°, the abutting angle between a blade and image bearing member is from 15 to 30°, and the pressure is from 5 to 15 g/cm.

An image bearing member used in the embodiment may be understood to mean one having on its surface a photosensitive layer. Preferable photosensitive material to be incorporated into a photosensitive layer may be amorphous chalcogenide material including amorphous selenium and an alloy thereof; II–VI group inorganic compound materials such as zinc oxide and cadmium sulfide; organic photoconductor material including high molecular series and resin dispersion complex series of low molecular weight organic compound; and amorphous silicon material. Of these, an image bearing member having a photosensitive layer comprised of amorphous silicon, with a high surface hardness, is preferable because a cleaning blade can be pressed strongly. As examples of amorphous silicon, there may be amorphous silicon germanium, amorphous silicon nitride, and material in which some hydrogen is substituted by fluorine.

The image bearing member used in the embodiment may be in any form of sheet, belt, web or drum. Belt or drum form is preferable in view of high speed and compactness.

The following examples and comparative examples are being supplied to further define the present invention, it being noted that these examples are intended to illustrate and not limit the scope of the present invention.

EXAMPLE 1

Into a coating machine ("SPIR-A-FLOW" (MINI)", manufactured by Freund Industrial Co., Ltd.) was placed 3 kg of magnetic material particles of manganese-zinc ferrite with 70 $\mu$m in mean particle size, 60 $Am^2/kg$ in saturation magnetization, and $5\times10^8\Omega\cdot cm$ in electric resistance. This machine was then activated to hold it in a flow state.

Separately, to 100 parts by weight of magnetic material particles, 2 parts by weight of methyl methacrylate and a thermoplastic copolymer resin (weight-average molecular weight: from 10000 to 20000) as its derivative, were dissolved in toluene to obtain a resin solution. After the resin solution was supplied to the coating machine, the surface of magnetic material particles was coated with the resin solution by means of spraying, followed by continuous drying in a flow state at 40° C. for one hour, thereby preparing coated carrier particles.

Then, the coating resin solution was dried and its hardness was determined by the measuring method as described above. Hardness was rank F.

The coated carriers were then mixed with the above-mentioned standard toner. Using a cleaning blade (62° in blade hardness, 8.8 g/cm in pressure, and 18.63° in abutting angle), and an image forming apparatus shown in FIG. 1, as attachment conditions, carrier lifetime, image, physical properties and cleaning performance were determined by the following measuring methods and criteria. The results are summarized in Table 1.

(i) Carrier Lifetime

A developer comprised of coated carrier particles and standard toner particle was placed into a developing unit of the image forming apparatus. The developer was stirred continuously and the time at which the so-called "front draw" occurred in image was regarded as carrier lifetime.

(ii) Image Density (I.D.) Measurement

The density of a black solid portion of a copied image was measured on a reflection density meter (Model #TC-6D, Tokyo Denshoku Co., Ltd.). The obtained value was employed as image density.

(iii) Fogging Density (F.D.) Measurement

The density of a blank portion of a paper sheet which has no copy image was measured on the reflection density meter. The obtained value was employed as fogging density.

(iv) T/D

The developer was collected from the developing sleeve surface and its weight were measured. After toner particles was separated from the developer by means of suction, its weight was measured and the percent by weight of the toner per developer was calculated.

(v) Charge Quantity

The developer was collected from the developing sleeve surface, and it was measured on a charge measuring system with isolation aspirator, manufactured by Sankyo Piotech Co., Ltd.

(vi) Spent Quantity

Upon termination of useful lifetime, only the carrier particles were separated from the developer. The content of carbon of initial carrier particles, and the content of carbon of toner particles adhered on the separated carrier particles were measured by a carbon analyzer. Thereafter, a difference between them was calculated. The amount of adhered toner particles (spent toner) was calculated in percentage by weight based on the calculated carbon content difference.

(vii) Cleaning Performance

The presence or absence of image contamination was observed to evaluate cleaning performance according to the following criteria: mark "×" means the presence of image contamination; mark "○" means the absence of image contamination (the cleaning blade lifetime corresponds to 200000 copied sheets); and mark "◎" means the absence of image contamination (the cleaning blade lifetime corresponds to 400000 copied sheets).

EXAMPLE 2

Cleaning performance was observed in the same manner as in Example 1, except that the cleaning blade property and attaching conditions were changed to 72° in hardness and 10.5 g/cm in pressure. The results are given in Table 1.

EXAMPLE 3

Cleaning performance was observed in the same manner as in Example 1, except that the cleaning blade property and attaching conditions were changed to 63° in hardness and 8.9 g/cm in pressure. The results are given in Table 1.

EXAMPLE 4

Cleaning performance was observed in the same manner as in Example 1, except that the cleaning blade property and attaching conditions were changed to 71° in blade hardness and 10.4 g/cm in pressure. The results are given in Table 1.

EXAMPLE 5

Coated carrier particle were prepared in the same manner as in Example 1, except for the use of a thermoplastic copolymer resin comprised of methyl methacrylate with a weight-average molecular weight of from 25000 to 30000, and its derivative. The coating resin solution was dried and its hardness was measured by the above-mentioned measuring method. Hardness was rank B. After the coated carriers were mixed with the above-mentioned standard toner particles, carrier lifetime, image, physical properties and cleaning performance were determined by using the above-mentioned image forming apparatus. The results are summarized in Table 1.

EXAMPLE 6

Coated carrier particles were prepared in the same manner as in Example 1, except that 0.5 part by weight of a thermoplastic copolymer resin comprised of methyl methacrylate (weight-average molecular weight: from 10000 to 20000) and its derivative, to 100 parts by weight of magnetic material particles, were dissolved in toluene to prepare a coating resin solution. The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 7

Coated carrier particles were prepared in the same manner as in Example 1, except that 5 parts by weight of a thermoplastic copolymer resin comprised of methyl methacrylate, (weight-average molecular weight: from 10000 to 20000) and its derivative, to 100 parts by weight of magnetic material particles, were dissolved in toluene to prepare a coating resin solution.

The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 8

Coated carrier particles were prepared in the same manner as in Example 1, except that 0.1 part by weight of aluminum oxide (particle size: 0.02 $\mu$m) to 100 parts by weight of magnetic material particles was dispersed into a coating resin solution.

The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 9

Coated carrier particles were prepared in the same manner as in Example 1, except that 10 parts by weight of aluminum oxide (particle size: 0.02 μm) to 100 parts by weight of magnetic material particles was dispersed into a coating resin solution.

The coating resin solution was dried and its hardness was measured on the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 10

Coated carrier particles were prepared in the same manner as in Example 1, except that 5 parts by weight of aluminum oxide (particle size: 0.005 μm) to 100 parts by weight of magnetic material particles was dispersed into a coating resin solution.

The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 11

Coated carrier particles were prepared in the same manner as in Example 1, except that 5 parts by weight of aluminum oxide (particle size: 1 μm) to 100 parts by weight of magnetic material particles was dispersed into a coating resin solution.

The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 12

Coated carrier particles were prepared in the same manner as in Example 1, except that 5 parts by weight of aluminum oxide (particle size: 0.02 μm) to 100 parts by weight of magnetic material particles was dispersed into a coating resin solution.

The coating resin solution was dried and its hardness was measured by the above-mentioned measuring method. Hardness was rank F.

After the coated carriers were mixed with the above-mentioned standard toner, carrier lifetime, image, physical properties and cleaning performance were determined by using the above-mentioned image forming apparatus. The results are summarized in Table 1.

EXAMPLE 13

Coated carrier particles were prepared in the same manner as in Example 1, except for the use of a magnetic material of manganese-zinc ferrite with an electrical resistance of $1.6\times10^{8}\Omega\cdot$cm. The results are given in Table 1.

EXAMPLE 14

Coated carrier particles were prepared in the same manner as in Example 1, except for the use of manganese-zinc ferrite with an electrical resistance of $1.2\times10^{10}\Omega\cdot$cm. The results are given in Table 1.

Comparative Example 1

Into a coating machine ("Universal mixing-stirring machine", manufactured by Dalton Co., Ltd.) was placed 3 kg of magnetic material particles of a magnetic material of manganese-zinc ferrite with 70 μm in mean particle size and 60 $Am^2/kg$ in saturation magnetization. Separately, to 100 parts by weight of magnetic material particles, 0.5 part by weight of a thermosetting acrylic modified silicon resin was dissolved in toluene to obtain a coating resin solution. This solution was supplied to the coating machine and mixed with stirring together with magnetic material particles. At this time, the temperature was maintained at 150° C., and the toluene was evaporated for curing the coating resin.

After the coating resin solution was dried and cured at 150° C., its hardness was determined by the measuring method as described above. Hardness was rank H.

The coated carriers were then mixed with the above-mentioned standard toner. Carrier lifetime, image, physical properties and cleaning performance were determined by using the above-mentioned image forming apparatus. The results are summarized in Table 1.

Comparative Example 2

Coated carrier particles were prepared in the same manner as in Comparative Example 1, except that the curing temperature was changed from 150° C. to 180° C. After the used coating resin solution was dried and cured at 180° C., its hardness was determined by the measuring method as described above. Hardness was rank 2H.

The coated carriers were then mixed with the above-mentioned standard toner. Carrier lifetime, image, physical properties and cleaning performance were determined by using the above-mentioned image forming apparatus. The results are summarized in Table 1.

Comparative Example 3

Into a coating machine ("SPIR-A-FLOW" (MINI)", manufactured by Freund Industrial. Co., Ltd.) was placed 3 kg of magnetic material particles of manganese-zinc ferrite with 70 μm in mean particle size and 60 $Am^2/kg$ in saturation magnetization. This machine was then activated to hold it in a flow state.

Separately, to 100 parts by weight of magnetic material particles, 2 parts by weight of methyl methacrylate and a thermoplastic copolymer resin (weight-average molecular weight: from 30000 to 40000) as its derivative, were dissolved in toluene to obtain a coating resin solution. The coating resin solution was supplied to the coating machine, and the surface of magnetic material particles was coated with the coating resin solution by means of spraying, followed by continuous drying in a flow state at 40° C. for one hour.

After the coating resin solution was dried, its hardness was determined by the measuring method as described above. Hardness was rank 2B.

The coated carriers were then mixed with the above-mentioned standard toner. Carrier lifetime, image, physical properties and cleaning performance were determined by using the above-mentioned image forming apparatus. The results are summarized in Table 1.

average molecular weight: from 10000 to 20000) as its derivative, to 100 parts by weight of magnetic material particles, were dissolved in toluene to prepare a coating resin solution. A number of aggregates of a size of several centimeters were recognized in the coated carriers.

TABLE 1

| | Coating Resin Hard-Ness | Resin Coating Qt. (parts by weight) | X (μC/g) | Y (μC/g) | Carrier Life-Time (hr) | Evaluation of Image: Initial I.D. | Evaluation of Image: Initial F.D. | Evaluation of Image: Upon termination of I.D. | Evaluation of Image: Upon termination of F.D. | Physical Properties: Initial T/D (%) | Physical Properties: Initial Charge Qt. (μC/g) | Physical Properties: Upon termination of useful lifetime T/D (%) | Physical Properties: Upon termination of useful lifetime Charge Qt. (μC/g) | Physical Properties: Upon termination of useful lifetime Spent Qt. (wt %) | Cleaning perfor-mance |
|---|---|---|---|---|---|---|---|---|---|---|---|---|---|---|---|
| Ex. 1 | F | 2 | 26.0 | 17.8 | 100.0 | 1.435 | 0.000 | 1.421 | 0.004 | 6.41 | −17.8 | 4.88 | −11.4 | −0.246 | ○ |
| Ex. 2 | ↑ | 2 | 26.0 | 17.8 | ↑ | ↑ | ↑ | ↑ | ↑ | ↑ | ↑ | ↑ | ↑ | ↑ | ○ |
| Ex. 3 | ↑ | 2 | 26.0 | 17.8 | ↑ | ↑ | ↑ | ↑ | ↑ | ↑ | ↑ | ↑ | ↑ | ↑ | ◎ |
| Ex. 4 | ↑ | 2 | 26.0 | 17.8 | ↑ | ↑ | ↑ | ↑ | ↑ | ↑ | ↑ | ↑ | ↑ | ↑ | ◎ |
| Ex. 5 | B | 2 | 26.0 | 18.3 | 90.0 | 1.440 | 0.001 | 1.422 | 0.003 | 6.50 | −18.3 | 4.68 | −12.3 | −0.253 | ○ |
| Ex. 6 | F | 0.5 | 26.0 | 18.3 | 91.3 | 1.421 | 0.001 | 1.438 | 0.001 | 6.25 | −18.3 | 4.77 | −12.4 | −0.218 | ○ |
| Ex. 7 | F | 5 | 26.0 | 19.8 | 132.5 | 1.405 | 0.000 | 1.410 | 0.001 | 6.37 | −19.8 | 4.36 | −12.8 | −0.387 | ○ |
| Ex. 8 | F | 2 | 26.0 | 18.2 | 108.6 | 1.436 | 0.000 | 1.422 | 0.002 | 6.28 | −18.2 | 4.44 | −11.5 | −0.247 | ○ |
| Ex. 9 | F | 2 | 26.0 | 22.9 | 110.1 | 1.417 | 0.001 | 1.439 | 0.001 | 6.48 | −21.9 | 4.17 | −13.1 | −0.278 | ○ |
| Ex. 10 | F | 2 | 26.0 | 17.2 | 111.7 | 1.425 | 0.002 | 1.422 | 0.002 | 6.14 | −17.2 | 4.28 | −10.8 | −0.233 | ○ |
| Ex. 11 | F | 2 | 26.0 | 20.6 | 113.5 | 1.441 | 0.001 | 1.432 | 0.001 | 6.33 | −20.6 | 4.51 | −10.5 | −0.266 | ○ |
| Ex. 12 | F | 2 | 26.0 | 20.0 | 120.5 | 1.430 | 0.000 | 1.417 | 0.000 | 6.28 | −20.0 | 4.74 | −12.3 | −0.250 | ○ |
| Ex. 13 | F | 2 | 20.1 | 17.5 | 91.7 | 1.437 | 0.001 | 1.455 | 0.002 | 6.33 | −17.5 | 4.38 | −9.8 | −0.242 | ○ |
| Ex. 14 | F | 2 | 29.4 | 20.8 | 96.8 | 1.402 | 0.000 | 1.392 | 0.000 | 6.27 | −20.8 | 4.31 | −13.2 | −0.227 | ○ |
| Com. Ex. 1 | H | 0.5 | 26.0 | 24.8 | 35.5 | 1.394 | 0.002 | 1.425 | 0.001 | 5.18 | −24.8 | 3.89 | −8.4 | 0.030 | ○ |
| Com. Ex. 2 | 2H | 0.5 | 26.0 | 23.8 | 43.7 | 1.460 | 0.002 | 1.448 | 0.000 | 5.27 | −23.8 | 4.84 | −10.3 | 0.050 | ○ |
| Com. Ex. 3 | 2B | 2 | 26.0 | 22.1 | 74.1 | 1.421 | 0.003 | 1.396 | 0.002 | 5.39 | −22.1 | 5.42 | −10.6 | −0.294 | ○ |
| Com. Ex. 4 | F | 2 | 26.0 | 17.8 | 100.0 | 1.435 | 0.000 | 1.421 | 0.004 | 6.41 | −17.8 | 4.88 | −11.4 | 0.246 | x |
| Com. Ex. 5 | F | 0.4 | 26.0 | 19.5 | 73.0 | 1.430 | 0.000 | 1.425 | 0.002 | 6.38 | −17.0 | 5.10 | −9.0 | −0.203 | ○ |
| Com. Ex. 6 | F | 6 | Preparation is impossible due to aggregation of magnetic material particles | | | | | | | | | | | | |

Comparative Example 4

Cleaning performance was observed in the same manner as in Example 1, except that cleaning was performed only by a cleaning brush in the above-mentioned image forming apparatus. The results are given in Table 1.

Comparative Example 5

Coated carrier particles were prepared in the same manner as in Example 1, except that 0.4 part by weight of methyl methacrylate and a thermoplastic copolymer resin (weight-average molecular weight: from 10000 to 20000) as its derivative, to 100 parts by weight of magnetic material particles, were dissolved in toluene to prepare a coating resin solution.

After the coating resin solution was dried, its hardness was determined by the measuring method as described above. Hardness was rank F.

The coated carriers were then mixed with the above-mentioned standard toner. Carrier lifetime, image, physical properties and cleaning performance were determined by using the above-mentioned image forming apparatus. The results are summarized in Table 1.

Comparative Example 6

Coated carrier particles were prepared in the same manner as in Example 1, except that 6 parts by weight of methyl methacrylate and a thermoplastic copolymer resin (weight- In the carrier for use in development of electrostatic latent image of Examples 1 to 14, the carrier lifetime was in the range of from 90 to 120 hours, which corresponds to from 350000 to 470000 copied sheets, showing an extended lifetime. Further, in every Example, the spent quantity upon termination of useful lifetime was negative, showing that the coating resin on the carrier surface had peeled during useful lifetime. The peeling of the coating resin functions to minimize the difference between the initial charge quantity and the charge quantity upon termination of useful lifetime. In the image forming apparatus of Examples 1 to 14, since the coating resin pieces separated from the carrier surface was cleaned and removed by the cleaning blade, no image contamination was observed below 200000 copied sheets, showing good cleaning performance.

Each of the carriers of Comparative Examples 1 to 3, 5 and 6 had "front draw phenomenon" below 75 hours (which corresponds to 283000 copied sheets). In Comparative Examples 1 and 2 using the thermosetting resin as a coating resin, the spent quantity was 0.030 wt % and 0.050 wt %, respectively, and the toner particles adhered to the carrier surface. In Comparative Examples 3 and 5 using the thermoplastic resin, the spent quantity was negative and the peeling of the coating resin was observed. However, since the coating resin was soft, its peeling speed was too high and "front draw" occurred after the elapse of 74.1 hours and 73 hours, respectively. The carrier of Comparative Example 6 aggregated and it could not be used. On the other hand, in Comparative Example 4 in which cleaning of the photoreceptor was carried out only by the cleaning brush, the carrier lifetime was 100 hours and the spent quantity upon termination of useful lifetime was negative. Therefore, the difference between the initial charge quantity and that of upon termination of useful lifetime was small, however, the coating resin pieces separated from the carrier surface could not be sufficiently cleaned and removed only by the cleaning brush as cleaner for photoreceptor. As a result, image contamination occurred below 200000 copied sheets.

What is claimed is:

1. A carrier for use in development of electrostatic latent image, comprising a magnetic material particle coated with a coating resin, the coating resin being a thermoplastic resin having a hardness of rank F to B in the terms of pencil scratch test, and being present in an amount of 0.5 to 5 parts by weight with respect to 100 parts by weight of the magnetic material particle.

2. A carrier according to claim 1, wherein the carrier satisfies the following equation:

$$(Y+2) \leqq X \leqq (Y+10) \quad (1)$$

wherein X ($\mu$C/g) denotes an absolute value of the saturated charge quantity of toner particles owing to friction with the magnetic material particles, and Y ($\mu$C/g) denotes an absolute value of the saturated charge quantity of toner particles owing to friction with the carrier particles.

3. A carrier according to claim 1 wherein particles having chargeability and/or conductivity and a particle size of 0.005 to 1 $\mu$m are present in an amount of 0.1 to 10 parts by weight to 100 parts by weight of the coating resin.

4. An image forming apparatus comprising:

a developing section for developing an electrostatic latent image formed on an image bearing member by a developer comprised of a carrier component and a toner component;

a transferring section for transferring a toner image on the image bearing member to copy paper; and a cleaning section having a cleaning blade for cleaning a surface of the image bearing member after transfer;

the carrier component including carrier particles each having a magnetic material particle coated with a coating resin, the coating resin being a thermoplastic resin having a hardness of rank F to B in the terms of pencil scratch test, and being present in an amount of 0.5 to 5 parts by weight with respect to 100 parts by weight of the magnetic material particle.

5. An image forming apparatus according to claim 4, wherein the carrier particle satisfies the equation:

$$(Y+2) \leqq X \leqq (Y+10) \quad (1)$$

wherein X ($\mu$C/g) denotes an absolute value of the saturated charge quantity of toner particles owing to friction with the magnetic material particles, and Y ($\mu$C/g) denotes an absolute value of the saturated charge quantity of toner particles owing to friction with the carrier particles.

6. An image forming apparatus according to claim 4, wherein the carrier particle contains particles having chargeability and/or conductivity and a particle size of 0.005 to 1 $\mu$m, in an amount of 0.1 to 10 parts by weight to 100 parts by weight of the coating resin.

7. An image forming apparatus according to claim 4, wherein the image bearing member includes a photoreceptor having a photosensitive layer comprised of amorphous silicon.

* * * * *